United States Patent [19]

Nakamura et al.

[11] Patent Number: 4,474,604

[45] Date of Patent: Oct. 2, 1984

[54] METHOD OF PRODUCING HIGH-GRADE METAL OR ALLOY POWDER

[75] Inventors: Hideki Nakamura, Yonago; Takashi Meguro, Yasugi; Noboru Hanai, Yonago, all of Japan

[73] Assignee: Hitachi Metals, Ltd., Tokyo, Japan

[21] Appl. No.: 490,044

[22] Filed: Apr. 29, 1983

[30] Foreign Application Priority Data

Apr. 30, 1982 [JP] Japan ..... 57-73041

[51] Int. Cl.[3] ..... B01J 2/02

[52] U.S. Cl. ..... 75/0.5 B; 75/0.5 BA; 75/0.5 BB; 75/0.5 BC; 75/0.5 C; 264/8

[58] Field of Search ..... 75/0.5 C; 264/8; 75/0.5 B, 0.5 BA, 0.5 BB, 0.5 BC

[56] References Cited

U.S. PATENT DOCUMENTS 3,829,538 8/1974 Darmara et al. ..... 266/8

4,358,415 11/1982 Tachimoto et al. ..... 266/8

*Primary Examiner*—W. Stallard

*Attorney, Agent, or Firm*—Finnegan, Henderson, Farabow, Garrett & Dunner

[57] ABSTRACT

A method of producing high-grade metal or alloy powder, improved to eliminate undesirable inclusions and to reduce the production cost. A solid electrode material made of a metal or alloy, having a composition substantially equal to the composition of aimed metal or alloy powder, is heated and molten in a vacuum chamber by application of a plasma, arc, electron beam or laser beam. The molten metal or alloy in the form of droplets fall into collision with the surface of a roll rotating at a high speed so as to be pulverized and partially solidified. The particles of the metal or alloy scattered by the roll is directed to one side of the roll and are spheroidized and solidified into fine particles before they are collected in a collecting box disposed at one side of the roll within the vacuum chamber.

5 Claims, 5 Drawing Figures

METHOD OF PRODUCING HIGH-GRADE METAL OR ALLOY POWDER

BACKGROUND OF THE INVENTION

The present invention relates to a method of producing high-grade metal or alloy powder and, more particularly, to a method of producing powder of metals containing so-called active elements which exhibit high affinity to oxygen or nitrogen, such as Ti, Nb and Al and their alloys, as well as powders of metals generally referred to as refractory metals such as Mo, W, Ta and their alloys.

Hitherto, various methods have been proposed and actually carried out for producing powders of these metals and alloys.

In one of these known methods called as "Inert Gas Atomization Process", the metal is first molten in vacuum and is then atomized by an inert gas such as Ar, He and so forth. In another known method called as "Rotating Electrode Process", arc is discharged to a rotating electrode of the metal or alloy to physically atomize the molten metal by the centrifugal force. Some of these methods have been put into practical use.

Most of these known methods include a step of making a molten metal or alloy pass through a refractory nozzle and to drip the same into vacuum or an inert gas. The produced powder of metal or alloy, therefore, inevitably has inclusions due to contamination of the refractory material of the nozzle. In consequence, the product unavoidably suffers from various shortcomings or inconveniences which undesirably impairs the reliability of the product material as a structural material, such as reduction in the low-cycle fatigue strength triggered by these inclusions. The aforementioned rotating electrode process, which does not necessitate any nozzle, has been proposed to overcome the above-mentioned shortcomings or inconveniences. This process, however, still suffers from disadvantages such as contamination of the product by W caused by a melting of the W electrode which cooperates with the rotating electrode in making the arc discharge therebetween. In order to overcome this problem, a method called as "Plasma Rotating Electrode Process" has been proposed as a modification of the rotating electrode process, in which a plasma jet of He gas is applied to the rotating electrode of the metal or alloy. This method, however, has not been put into practical use due to a problem of entrapment of ionized He gas by the product metal or alloy powder, because the application of the plasma jet is effected in the He gas atmosphere of substantially atmospheric pressure to permit the ionization of the He gas by the plasma. In addition, the methods employing the rotating electrode require solid electrode material having a superior quality without any defect such as shrinkage cavities, in order that the solid electrode material withstands a high mechanical tensile force applied by the centrifugal force during the operation rotating at high speed. The production of the solid electrode of such a superior quality necessitates various steps such as forging, rolling and so forth to impose a problem from the view point of economy.

Thus, all of the methods and apparatus for producing metal or alloy powder proposed and used hitherto involves various problems or drawbacks, which constitutes a bottleneck in spreading the use of powder of superalloys and Ti alloy.

SUMMARY OF THE INVENTION

Accordingly, it is a primary object of the invention to provide a method of producing high-grade metal or alloy powder, improved to overcome the above-described problems of the prior art.

The method in accordance with the invention is similar to the known methods in that it makes use of a solid material to be molten having substantially the same composition as the composition of the powder to be obtained. However, in contrast to the above-mentioned known rotating electrode method, the method of the invention does require the high-speed rotation of the solid material. In addition, the surface of the solid material is heated and molten at a high heat density by the application of plasma or arc under vacuum or by application of electron beam, laser beam or the like, and the droplets of the material dripping from the molten solid material are made to fall into collision with the surface of a roll rotating at a high speed, thereby to effect a pulverization, scattering and cooling of the droplets on the roll surface.

According to an aspect of the invention, the axis of rotation of the roll is slightly offset from the path along which the droplets of molten metal falls, so that the droplets scattered by the roll in the molten or solidified state are made to concentrate to one side of the rotating roll. Unlike the known methods in which the molten metal is cooled by a gas flowing at high velocity, the molten metal is cooled very rapidly in the method of the invention through the contact with the solid roll which produces also a pulverizing effect due to the energy of collision and the energy imparted by the high peripheral speed of the roll surface to afford an easy and efficient pulverization of the molten metal into fine powder. Furthermore, since the particles scattered by the roll are directed to a rather small area in one direction, it is possible to decrease the volume of the vacuum chamber and, hence, to reduce the installation cost remarkably. A further restriction or convergence of the flying direction of the scattered particles can be attained to enhance the pulverizing effect by the use of a roll which is radially contracted at the axially mid portion.

In the method of the invention starting with the melting of the metal and ending in the solidification of the same, there is no chance for the metal to contact with the refractory material so that the produced powder can have a high purity. Furthermore, the production cost of the solid electrode material can be reduced economically, since the requirement for superior quality of the electrode material is less severe because the solid electrode material is rotated so slowly as not to impose large mechanical load on the solid electrode material. A higher economy is achieved also by the elimination of the necessity for expensive gas such as Ar and He as the atomizing gas which is essential in the known inert gas atomizing process. As to the heat source for melting the solid electrode material, it is possible to use any known means which can develop a high heat density on the surface of the solid electrode material as stated before to efficiently and easily melt the latter.

The invention overcomes also the problem concerning the entrapment of the gas in the powder, because the droplets are solidified substantially under vacuum. As mentioned before, a plasma or arc under vacuum and beams such as electron beam and laser beam can effectively be used as the heat source for melting the solid electrode material. The vacuum arc, however, is rather difficult to converge, while the electron beam and laser beam require considerable money for the construction of the system. Thus, it is advisable to use plasma in vacuum, partly because the plasma beam is easy to control and partly because the heating system can be constructed at a comparatively low cost.

Other objects, features and advantages of the invention will become clear from the following description of the preferred embodiment taken in conjunction with the accompanying drawings.

DESCRIPTION OF THE PREFERRED EMBODIMENTS

Figure 1:
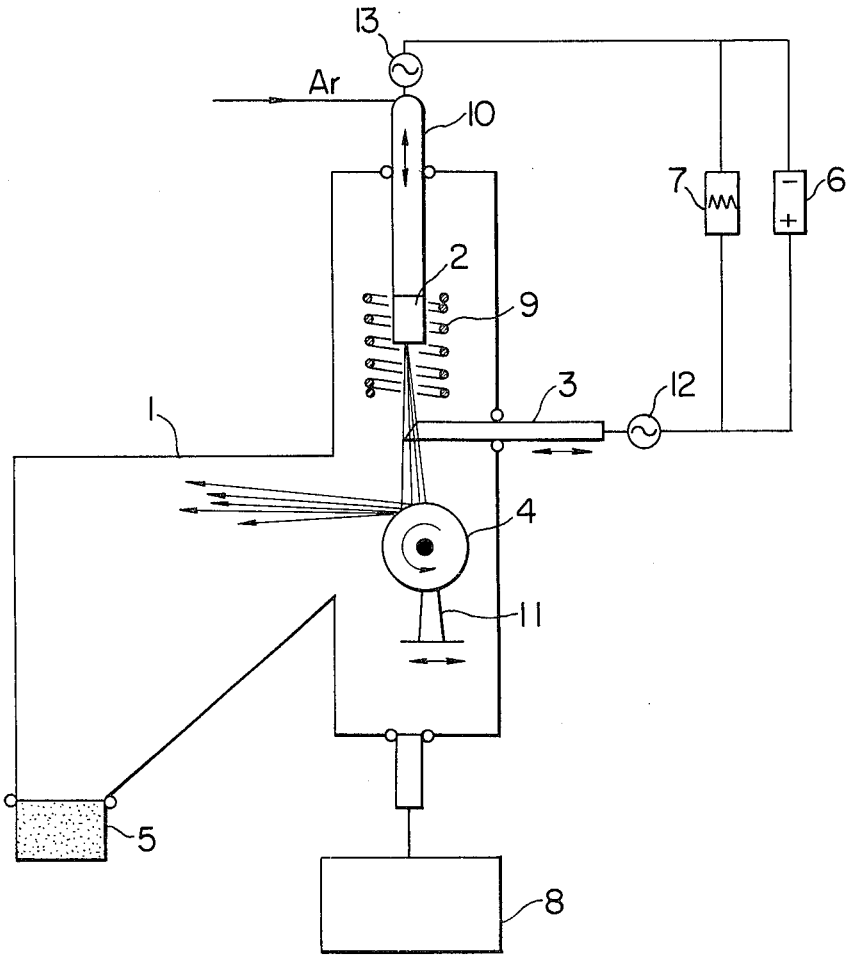
FIG. 1 is an illustration of the principle of a production method in accordance with the invention.

Referring first to FIG. 1 which diagramatically shows a system for carrying out a production method of the invention, a vacuum chamber 1 is evacuated by vacuum pump 8 to a suitable level of vacuum. A vacuum plasma gun 2 is supported by a support member 10 and is placed at an upper part of the space inside the vacuum chamber 1. The support member 10 and, hence, the vacuum plasma gun 2 is movable up and down by the power of a driving motor 13. An electrode 3, which is a solid material having the same composition as the powder to be obtained is movable in the horizontal direction by a driving motor 12. A plasma power source 6 is disposed between the vacuum plasma gun 2 and the electrode 2. The vacuum chamber 1 is beforehand evacuated to a high vacuum of $10^{-3}$ Torr. or higher and is charged with Ar gas as the plasma source gas. In some cases, the air in the vacuum chamber 1 is substituted by an inert gas such as Ar in advance to the evacuation of the chamber 1. The vacuum chamber 1 after charging with the Ar gas is maintained at a vacuum of a level ranging between $10^{-1}$ to $10^{-3}$ Torr. Then, a plasma is generated between the plasma gun 2 and the electrode 3 by the operation of a high-frequency electric power source 7. After the generation of the plasma, the high-frequency electric power source is stopped and the plasma power source 6 starts to operate insteadly to maintain the plasma continuously. By irradiating the axially movable electrode 3 with the plasma, the surface of the electrode 3 is molten to form droplets of the molten metal which fall at high velocity in the direction of running of the plasma into collsion with a roll 4 which is rotating at a high peripheral speed so as to be pulverized and scattered by the roll surface. The position of the axis of rotation of the roll 4 is adjustable in the horizontal direction with respect to the path of fall of the droplets to permit the control of the flying direction of the droplets or particles scattered by the roll. The droplets which could not be solidified through contact with the roll surface are solidified into spherical form, and are collected in a dust collecting box 5. A cast electrode with or without a subsequent forging or a briquette formed from powdered material may be used as the electrode 3.

Examples of thet method of the invention, carried out with the system illustrated in FIG. 1, are shown below.

EXAMPLE 1

As the material electrode, an ingot of 200 mm dia. and 1000 mm long was formed by vacuum arc melting process from Ti-6A1-4V alloy. A plasma beam was applied at a power of 350 KW to the electrode within the vacuum chamber maintained at a vacuum of $10^{-2}$ Torr., while moving the electrode in the horizontal direction at a speed of 4 cm/min. The droplets of the molten alloy were made to fall onto the roll of 400 mm dia. and 400 mm long rotated at a speed of 100 rpm. More specifically, the position of the rotation axis of the roll was so adjusted that the droplets of molten alloy fall onto the portion of the roll surface which is spaced 30° from the vertical line passing through the axis of the roll. Powders produced by this method were spheroidized particles having a mean particle size of 130 μm and the maximum particle size of 400 μm. The yield of the powders of particle sizes less than 150 μm was 75%.

EXAMPLE 2

An electrode of the same size as Example 1 was formed from Inco 718. The condition was materially identical to that in Example 1, except that the roll speed was increased to 1500 rpm. The powders formed by this method were spheroidized particles having a mean particle size and the maximum particle size of 65 μm and 170 μm, respectively. The yield of the powders having particle sizes less than 150 μm was 90%. The oxygen content, nirogen content and the hydrogen content of the powder were 34 ppm, 23 ppm and 0.2 ppm, respectively.

EXAMPLE 3

Figure 2A:
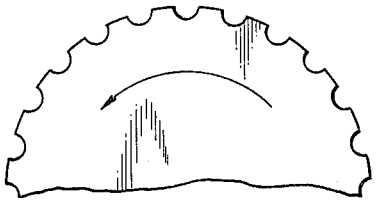
FIG. 2*a* is an end view of a portion of a roll for use in carrying out the method of the invention, having semi-circular axial grooves in the peripheral surface thereof.
Figure 2B:
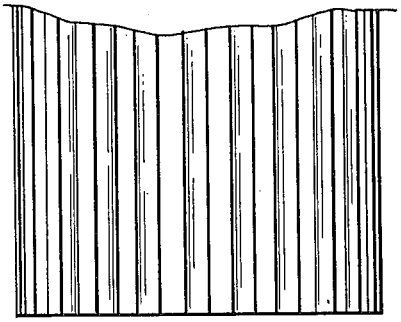
FIG. 2*b* is a plan view of the portion of the roll shown in FIG. 2*a;*

A test production was conducted to investigate the influence of the nature of the roll surface on the pulverizing effect. The test was conducted under the same condition as Example 2, except that the roll surface was provided with a multiplitity of axial liner grooves having a semicircular cross-section as shown in FIG. 2*a* and FIG. 2*b*. The diameter of the semicircular cross-section of the grooves and the pitch of the same were 1 mm. The powders produced were spheroidized particles having a mean particle size and maximum particle size of 40 μm and 140 μm, respectively. The yield of the powders having particle sizes less than 100 μm was 90%. It was thus confirmed that the roll surface having a multiplicity of grooves remarkably improves the pulverizing effect. It proved also that the pulverizing effect is largely affected by the "wettability" of the roll surface to the droplets of the molten metal or alloy. Namely, the smaller wettability of the roll surface ensures a finer powder, i.e. the smaller particle size of the spheroidized powder.

EXAMPLE 4

Figure 3:
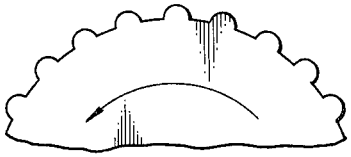
FIG. 3 is an end view of a portion of a modification of the roll, having semi-circular axial ridges on the outer peripheral surface thereof.

A test was conducted under the same condition as Example 3, except that as shown in FIG. 3 the surface of the roll used had a multiplicity of axial linear ridges having a semicircular cross-section insteadly of the grooves. As a result, a 10% increase in the pulverizing effect was confirmed as compared with that attained in Example 2.

EXAMPLE 5

Figure 4:
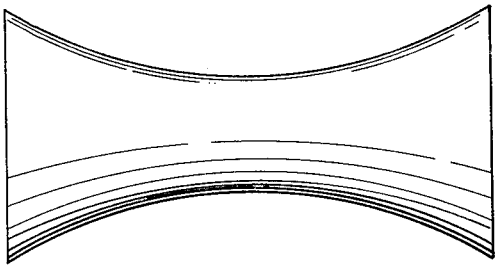
FIG. 4 is a side elevational view of another example of the roll which is contracted at its axial mid portion thereof.

A test was conducted with a roll which had, as shown in FIG. 4, a profile radially contracted at axially mid portion thereof, to have an axial length of 300 mm and maximum and minimum diameters of 280 mm and 200 mm, respectively. The test condition was materially identical to that in Example 2, but a remarkable effect was confirmed in the convergence of the scattered particles or droplets to facilitate the collection as compared with Example 2. The convergence of the flow of the scattered droplets or particles affords also about 30 $\mu$m reduction in mean paticle size.

Although the invention has been described through specific term, it is to be noted here that the described embodiment is not exclusive and various changes and modifications may be imparted thereto without departing from the scope of the invention which is limited solely by the appended claims.

What is claimed is:

1. A method of producing high-grade metal or metal alloy powder, said method comprising the steps of:

(a) providing a consumable electrode having a composition substantially identical to the desired composition of said powder, said electrode comprising the anode with respect to the cathode of a plasma gun;

(b) maintaining said electrode and said cathode of said plasma gun at a vacuum at a pressure in the range of from about $10^{-1}$ to $10^{-3}$ Torr.;

(c) generating a plasma between said electrode and said plasma gun such that a portion of said electrode is melted, said molten material forming drops disposed to fall from said electrode onto the outer peripheral surface of a substantially cylindrical roll;

(d) pulverizing said drops by rotating said roll at high speed and thereby imparting energy to said drops; and (e) solidifying said pulverized drops to form said powder.

2. A method of producing high-grade metal or alloy powder according to claim 8 wherein said consumable electrode is a horizontally elongated rod-like member adapted to be heated and molten at one end surface thereof.

3. A method of producing high-grade metal or alloy powder according to claim 1 or 2, wherein said roll is adjustable with respect to the path along which said drops fall.

4. A method of producing high-grade metal or alloy powder according to claim 1, 2 or 3, wherein the surface of said roll includes a plurality of ridges or grooves extending in the axial direction of said roll.

5. A method of producing high-grade metal or alloy powder according to claim 1, 2, 3 or 4, wherein said roll includes on its outer peripheral surface at least one radial contraction.

* * * * *

UNITED STATES PATENT AND TRADEMARK OFFICE

CERTIFICATE OF CORRECTION

PATENT NO. : 4,474,604

DATED : October 2, 1984

INVENTOR(S) : Hideki Nakamura, Takashi Meguro and Noboru Hanai

It is certified that error appears in the above-identified patent and that said Letters Patent is hereby corrected as shown below:

IN THE CLAIMS:

In claim 2, line 15, change "claim 8" to --claim 1--

Signed and Sealed this

*Thirtieth* Day of *April 1985*

[SEAL]

*Attest:*

DONALD J. QUIGG

*Attesting Officer*

*Acting Commissioner of Patents and Trademarks*